US009777532B2

(12) United States Patent
Parish

(10) Patent No.: US 9,777,532 B2
(45) Date of Patent: Oct. 3, 2017

(54) DOUBLE BACKBONE CORE FOR AUTOMATED DOOR ASSEMBLY LINE, DOOR COMPRISING SAME AND METHOD OF USING SAME

(71) Applicant: Masonite Corporation, Tampa, FL (US)

(72) Inventor: James G. Parish, Luray, VA (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 14/663,954

(22) Filed: Mar. 20, 2015

(65) Prior Publication Data

US 2015/0267461 A1 Sep. 24, 2015

Related U.S. Application Data

(60) Provisional application No. 61/968,153, filed on Mar. 20, 2014.

(51) Int. Cl.
*E04C 2/36* (2006.01)
*E06B 3/70* (2006.01)

(52) U.S. Cl.
CPC ..... *E06B 3/7001* (2013.01); *E06B 3/7017* (2013.01); *E06B 2003/7019* (2013.01)

(58) Field of Classification Search
None
See application file for complete search history.

(56) References Cited

U.S. PATENT DOCUMENTS

| | | | | | |
|---|---|---|---|---|---|
| 2,073,896 | A | * | 3/1937 | Loctscher | 52/793.11 |
| 2,173,808 | A | * | 9/1939 | Kellogg | 428/116 |
| 2,272,227 | A | * | 2/1942 | Thomas | 428/116 |
| 2,511,620 | A | * | 6/1950 | MacMillan | 49/503 |
| 2,660,766 | A | * | 12/1953 | Petterson | 428/120 |
| 2,695,430 | A | * | 11/1954 | Wakefield | 428/34 |
| 2,824,630 | A | | 2/1958 | Tolman | |
| 2,827,670 | A | * | 3/1958 | Schwindt | 52/784.14 |
| 2,849,758 | A | * | 9/1958 | Plumley et al. | 52/309.15 |
| 2,893,076 | A | | 7/1959 | Herts | |
| 3,385,002 | A | * | 5/1968 | Quinif | 49/501 |
| 3,404,502 | A | * | 10/1968 | Miller | E06B 3/7001 52/311.2 |
| 4,294,055 | A | | 10/1981 | Andresen | |
| 4,550,540 | A | * | 11/1985 | Thorn | 52/309.4 |
| 4,583,338 | A | * | 4/1986 | Sewell et al. | 52/456 |
| 4,922,674 | A | * | 5/1990 | Thorn | 52/309.15 |
| 5,052,164 | A | * | 10/1991 | Sandow | 52/786.13 |
| 5,157,892 | A | * | 10/1992 | Ryther | 52/793.11 |
| 5,167,105 | A | * | 12/1992 | Isban et al. | 52/455 |
| 5,417,788 | A | | 5/1995 | Holt | |
| 5,644,870 | A | * | 7/1997 | Chen | 49/501 |
| 5,875,608 | A | * | 3/1999 | Quinif | 52/784.14 |
| 5,992,127 | A | * | 11/1999 | Quinif | E04C 2/36 428/116 |

(Continued)

*Primary Examiner* — Patrick J Maestri
(74) *Attorney, Agent, or Firm* — Berenato & White, LLC

(57) ABSTRACT

The present invention relates to a double backbone core for automated hollow door manufacture and a door comprising same. The double backbone core comprises an expandable core component comprising two backbones with relatively smaller cells running parallel to one another along the length dimension of the door, wherein the core is formed from a plurality of interconnected strips.

15 Claims, 8 Drawing Sheets

(56) References Cited

U.S. PATENT DOCUMENTS

| | | | | |
|---|---|---|---|---|
| 6,132,836 | A * | 10/2000 | Quinif | 428/68 |
| 6,892,993 | B2 * | 5/2005 | Palmer | 248/346.02 |
| 9,085,933 | B1 * | 7/2015 | Crittenden | E06B 3/72 |
| 2003/0033786 | A1 * | 2/2003 | Yulkowski | 52/784.15 |
| 2006/0037281 | A1 * | 2/2006 | Yong et al. | 52/784.14 |
| 2006/0269720 | A1 * | 11/2006 | Guanci | 428/72 |
| 2009/0183455 | A1 * | 7/2009 | Polk et al. | 52/309.1 |
| 2012/0048487 | A1 * | 3/2012 | Brewster et al. | 160/368.1 |

* cited by examiner

DOUBLE BACKBONE CORE FOR AUTOMATED DOOR ASSEMBLY LINE, DOOR COMPRISING SAME AND METHOD OF USING SAME

CROSS-REFERENCE TO RELATED APPLICATIONS

Claim to Priority

This application is related to provisional patent application no. 61/968,153, filed Mar. 20, 2014 in the United States, the disclosure of which is incorporated herein by reference and to which priority is claimed.

FIELD OF THE INVENTION

The invention relates to a core having two interconnected backbones for use in a door assembly, preferably in an automated door assembly line, and a hollow core door formed with the core. More specifically, the present invention relates to an expandable core component for a hollow door, comprising two backbones with relatively smaller cells running parallel to one another along the length dimension of the door that are configured so as not to interfere with hinge blocks, lock blocks, etc., as well as a method of using same in an automated door assembly line.

BACKGROUND OF THE INVENTION

Current hollow core doors have a central lengthwise extending core with a backbone of relatively small cells. These single backbone cores when used in automated door manufacturing have a tendency to curve to one side or the other depending upon variations in the core, the door being assembled and manufacturing inconsistencies. This may cause both performance issues on the automated line and quality issues when the core movement causes the molded panels on one side to have insufficient support, i.e., pillowing.

U.S. Pat. No. 4,583,338 to Sewell, et al., discloses a hollow door panel construction including a rectangular frame of predetermined thickness assembled from side and end members defining an elongated enclosure. Within the enclosure are corrugated paperboard strips, having a width equal to the predetermined thickness. The strips are variously formed and attached to define a plurality of horizontal cell rows, vertically stacked to fill the framed volume. Each cell row spans the internal width of the frame, and includes a centrally positioned short-walled brace cell straddled on either side by a long-walled lateral cell. To complete the panel construction, thin sheets abut and are secured to the opposite faces of the frame and to the outer edges of the strips. In essence, Sewell discloses a single back bone core designed to provide greater door strength. However, as with all single backbone cores, Sewell's single backbone core has a tendency to curve to one side or the other during automated manufacturing depending upon variations in the core. When this curving occurs, the molded panels on one side tend to have insufficient support.

U.S. Pat. No. 2,827,670 to Schwindt discloses a hollow core door wherein the surface sheets have limited relative longitudinal movement with respect to each other and rigid connection of the surface sheets to longitudinally extending stiles is eliminated. Schwindt discloses a single backbone core structure using a higher concentration of cellular material in the vicinity of the edges along the stiles and rails. As with Sewell, the core of Schwindt would have a tendency to curve during manufacture.

There remains a need for a core that provides a more consistent position and coverage in hollow core doors, that resolves both the automated line manufacturing issues such as interference with the hinge blocks and lock blocks, and that resolves quality issues that occur when the door facings have insufficient support from the core.

SUMMARY OF THE INVENTION

The present invention relates to a double backbone core for use in an automated door assembly line. An expandable core, preferably formed from cardboard or corrugated cardboard, is interposed between two opposed door skins during fabrication of the door on an automated assembly line. The core is appropriately configured so as not to interfere with hinge blocks, lock blocks, etc. Instead of the currently used core having a single central backbone of relatively small cells, the present invention utilizes two backbones with relatively small cells running parallel to one another along the length dimension of the door.

The present invention relates to a double backbone core with smaller cells on the ends (outside) and optionally larger cells in the middle. The smaller cells create a relatively straight support extending parallel to the stiles and the larger cells provide cross support through the middle of the door. In four-molded-panel and six-molded-panel door designs, the backbones are disposed near the edges of the molded (or profiled) panels, with the optional larger cells supporting the middle of the molded panels.

The backbones at the edges pull tight to provide straight edges for the core that are less likely to interfere with the lock blocks during automated manufacturing.

The backbones are located either near the center of the molded panels or near the outside edges of the molded panels. A similar core concept is used for two and three-panel doors with ridged edges and central cells.

Manual assembly of four and six-molded-panel doors does not allow for a core that could run the length of the door through the molded panels. As such, the core was placed in the center of the door. Having two backbones running through/underneath the molded panels not only resolves the pillowing issue but also provides oil canning and warp resistance as well.

The core of the invention may be used with different width doors. The 3/0 core backbones are aligned in the middle of the 3/0 molded panels. For the 2/10 and 2/8 molded molded panels, the core is nearer to the edge of but still away from the lock blocks. The 2/6 is preferably configured the same as the 2/4, and the 2/0 core is preferably also used for the 2/2 door.

Because the tight portion of the core is configured on the outside edges of the core, this core is more forgiving with making undercut doors (6/7-1/2), which has been problematic with current single, central core designs.

BRIEF DESCRIPTION OF THE FIGURES

The foregoing background and summary, as well as the following detailed description of the preferred embodiments, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENT(S)

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
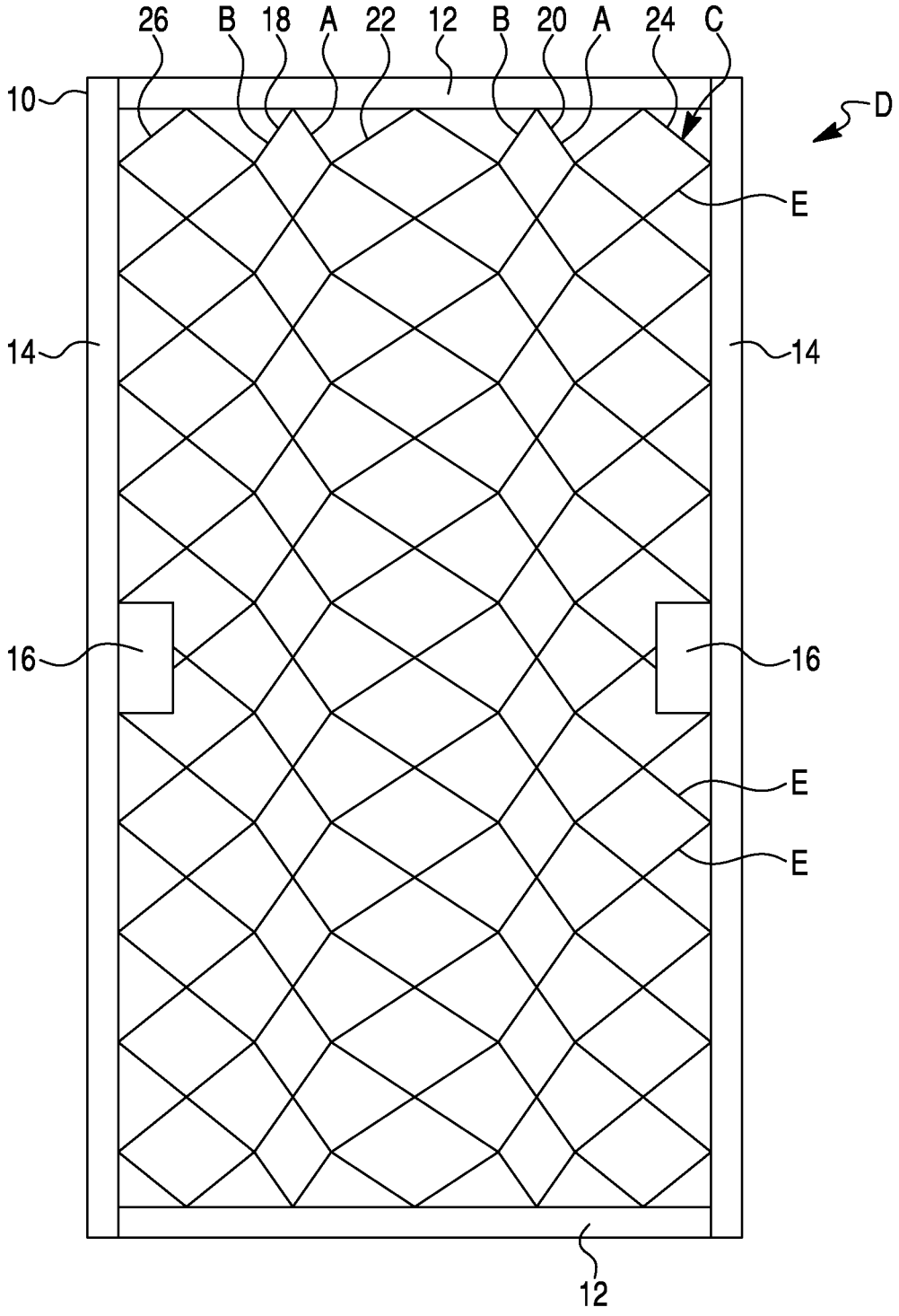
FIG. 1 is a cross-sectional view of a door according to an exemplary embodiment of the present disclosure.

FIG. 1 illustrates a door D comprising a peripheral frame 10 and a core component C. Frame 10 comprises rails 12, stiles 14, and lock blocks 16. The rails 12 and the stiles 14 are coupled together, typically with adhesive or mechanical fasteners, to form the frame 10. The rails 12 and the stiles 14 are typically formed of wood, although other materials such as composites and polymers may be used. The lock blocks 16 can be adhesively secured to the stiles to provide support for a door handle and/or a locking mechanism at the periphery of the door. The frame 10 may also include hinge blocks adhesively secured to the stiles to allow attachment of door hinges.

The core component C comprises a first backbone 18 extending the length of the door D, a second backbone 20 extending the length of the door D, and connective cellular portions 22, 24, 26 connecting the first and second backbones 18, 20. Various materials can be used for the core component C such as cardboard, corrugated cardboard, paperboard, paper, or wood composite material, such as composite soft board or wood fibers. In an exemplary embodiment, the core component C is formed of a plurality of thin strips of cardboard where the strips are interconnected to form cells, such that the cells expand to fill the hollow space created within the frame 10.

Figure 5:
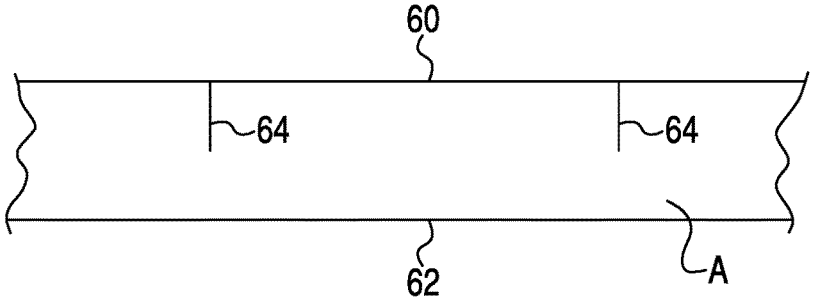
FIG. 5 is an elevational view of a first strip used to form the core.

FIG. 5 illustrates a first strip A, preferably formed of corrugated cardboard or heavy paper board. The strip A has parallel edges 60 and 62, and a plurality of adhesive lines 64 deposited on the strip A. The adhesive 64 can be any known bonding material, such as polyvinyl acetate, hot melt adhesive, PUR adhesive, etc. The adhesive 64 preferably extends at least half and preferably the entire distance between the edges 60 and 62.

Figure 6:
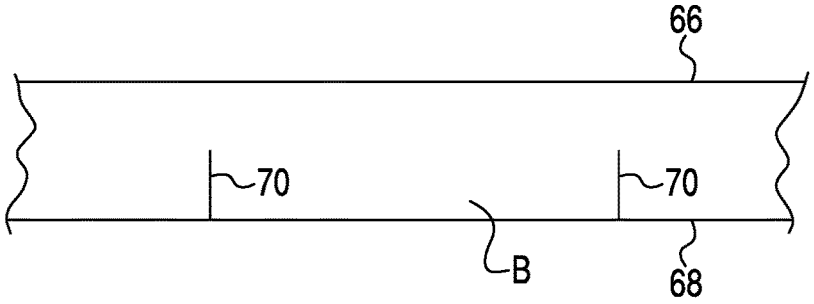
FIG. 6 is an elevational view of a second strip used to form the core.

FIG. 6 illustrates a second strip B, also preferably formed of corrugated cardboard or heavy paperboard. The strip B has parallel edges 66 and 68 and a plurality of adhesive lines 70 deposited on strip B. As with strip A, the adhesive 70 extends at least halfway, preferably the entirely distance, between the spaced parallel edges 66 and 68. The strips A and B have a uniform height as defined by the edges 60, 62 and 66, 68, respectively.

Figure 7:
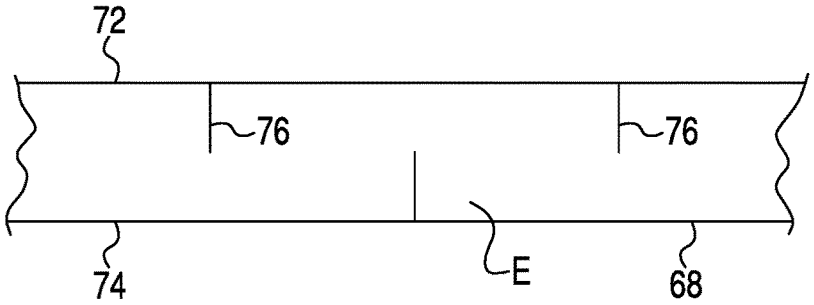
FIG. 7 is an elevational view of a third strip used to form the core.

As best shown in FIG. 7, strip E has a uniform height defined by its parallel edges 72 and 74, and a plurality of adhesive lines 76 and 78. The strip E has a uniform height as defined by its edges 72 and 74 that corresponds to and matches the heights of strips A and B. The strip E likewise is preferably made of corrugated cardboard or heavy paperboard.

Figure 2:
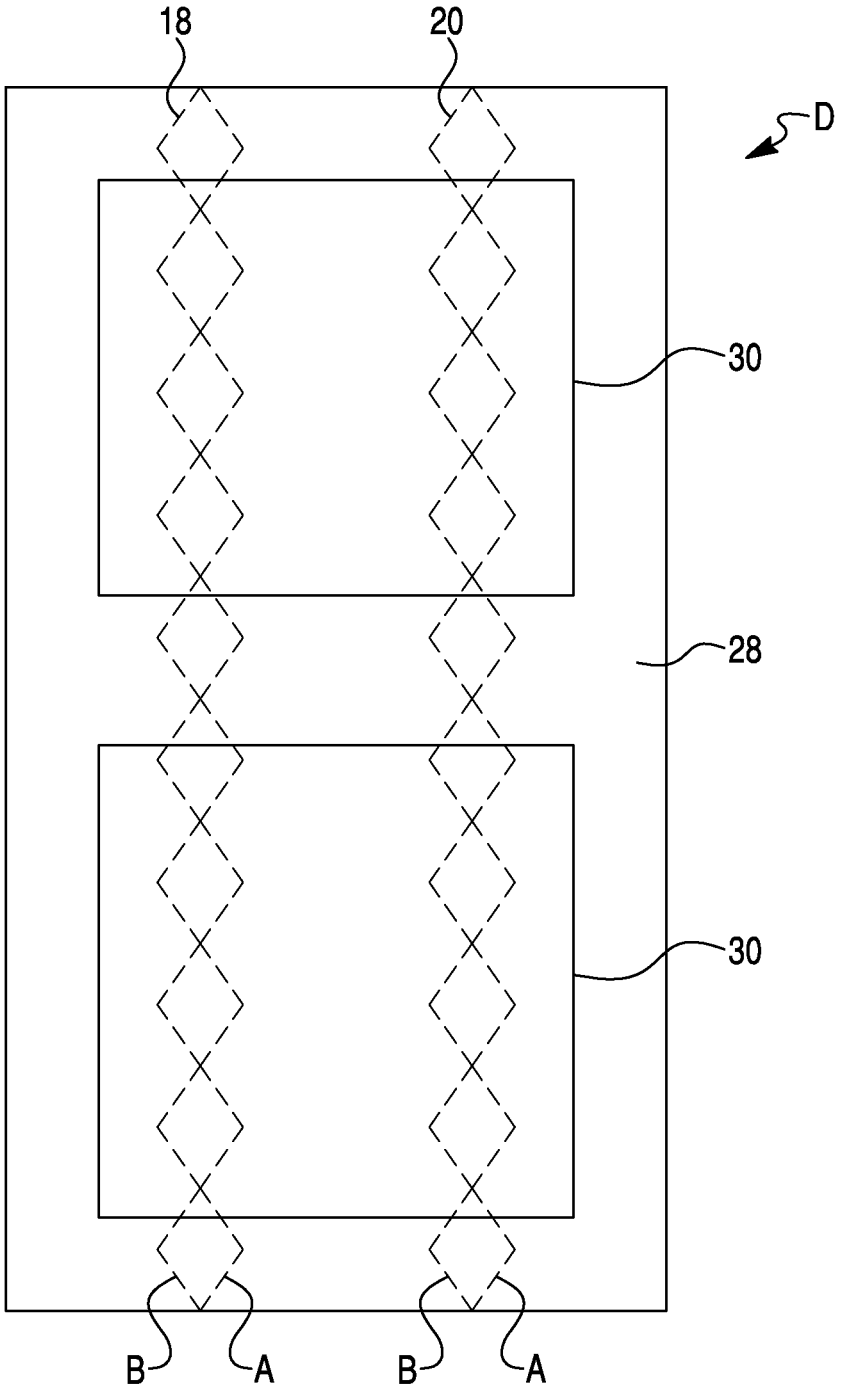
FIG. 2 is an elevation view of an exemplary two-molded-panel door according to an exemplary embodiment of the present disclosure.

In assembling the core C, the strips A and B are coupled together by bonding the adhesive lines 64 and 70 in order to create the longitudinally extending honeycomb pattern illustrated in FIG. 2 having the backbones 18 and 20. A plurality of strips E are bonded between the strips A and B in order to interconnect the backbones 18 and 20, thus creating the cellular portions 22, 24, 26. The strips E may also be bonded between adjacent strips E in order to create a core C having strips A, B and E, as best shown in FIG. 1.

Figure 8:
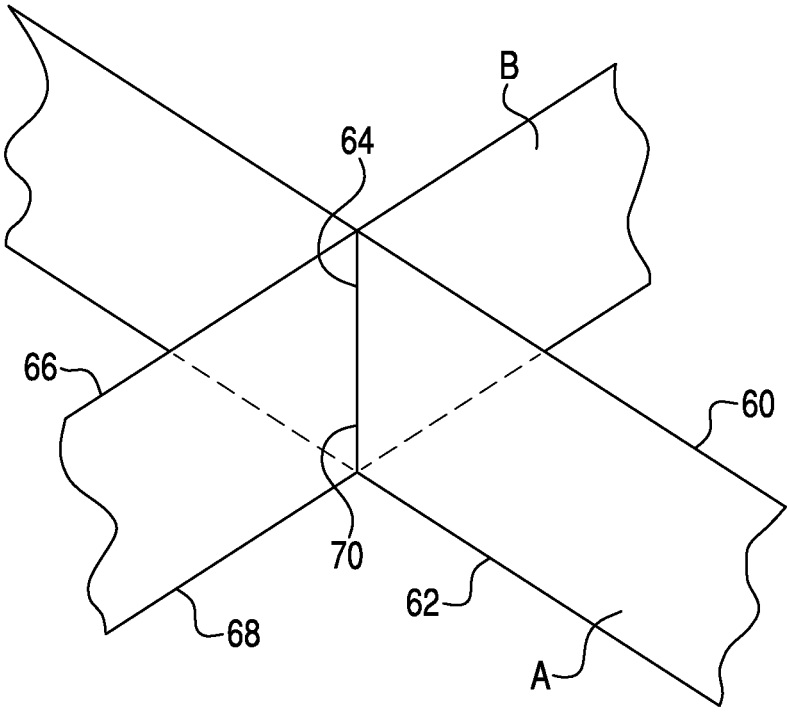
FIG. 8 is a fragmentary perspective view of the first and second strips connected via slits in the strips to form the backbones.

In yet another embodiment, the strips A and B can also include slits or cut lines extending through the strips A and B, located where the adhesive lines 64 and 70 are located. The slits extend approximately half of the distance between the spaced parallel edges 60 and 62 or 66 and 68. To form the back bones, the slits 64 and 70 slide together to form a connection between the strips A and B as best shown in FIG. 8. The adhesive may be present at the slits to allow for a more secure connection.

First backbone 18 and the second backbone 20 each comprise a plurality of cells arranged in a parallel configuration along the length of door D. The cells of the first backbone 18 and the second backbone 20 can have any shape. In an exemplary embodiment, the cells of backbones 18, 20 are quadrangular or diamond-shaped such that the cells extend in a longitudinal direction of the door D where the length of each cell is greater than the width.

Optional connective cellular portions 22, 24, 26 comprise a plurality of cells, each having an area larger than the area of the cell formed by strips A and B associated with backbones 18, 20. While the connective portions are illustrated as being cellular, they can be corrugated cardboard panels connected to the relatively smaller cells of the backbones 18, 20. The connective portion 22 is disposed between the backbones 18, 20 and the connective portions 24, 26 extend outwardly from backbones 18, 20 toward the stiles 14 of frame 10. The cells of connective portions 22, 24, 26 can have any shape. In an exemplary embodiment, the cells of connective portions 22, 24, 26 can be quadrangular or diamond-shaped such that the cells extend in a latitudinal direction of the door D where the width of each cell is greater than the length. The cellular portions 24, 26 are configured to not interfere with lock blocks 16 and/or hinge blocks (not shown). Preferably, the cell density of the backbones 18, 20 is greater than that of the cellular portions 22, 24, 26.

Figure 3:
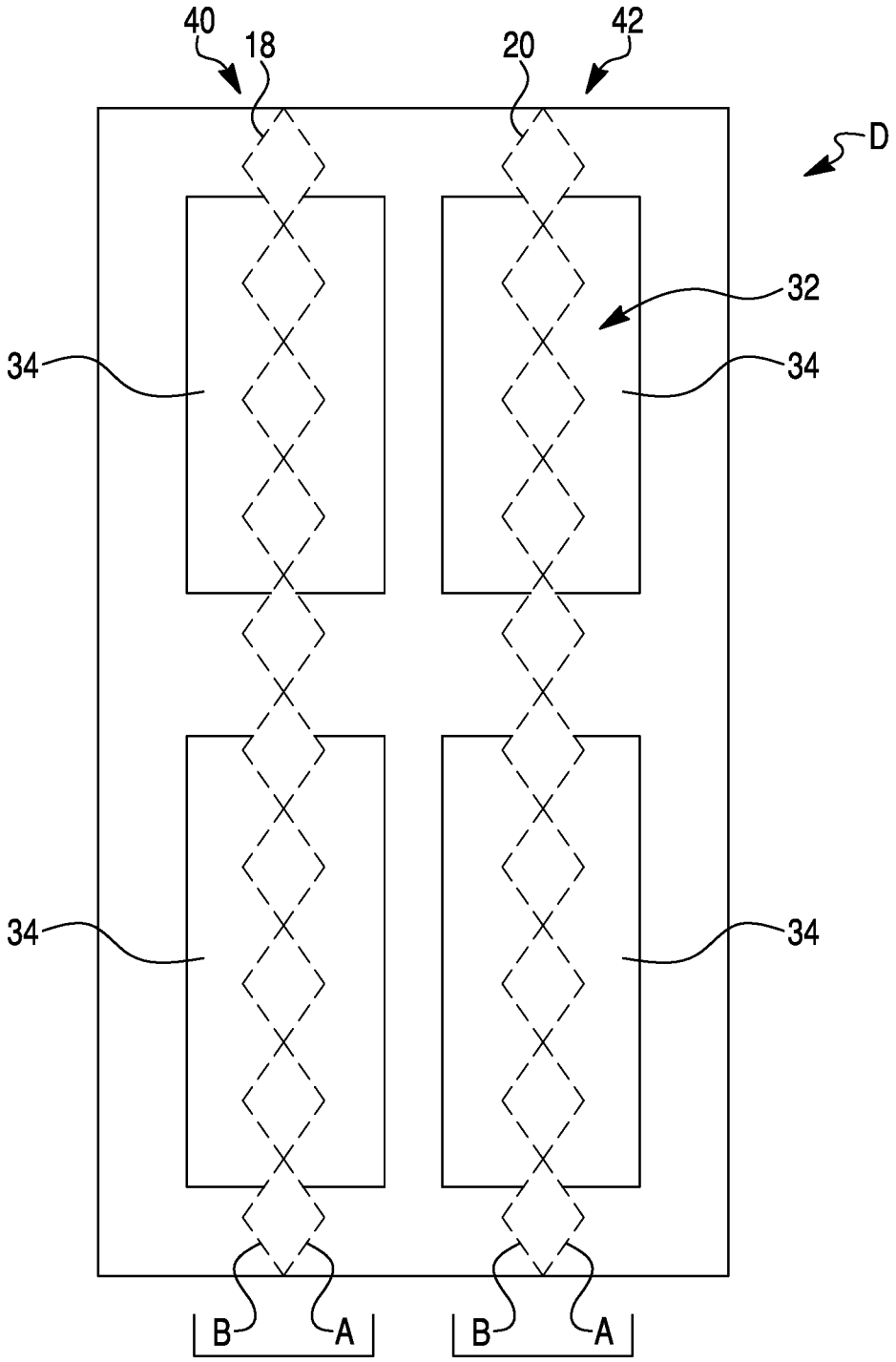
FIG. 3 is an elevational view of an exemplary four-molded-panel door according to an exemplary embodiment of the present disclosure.
Figure 4:
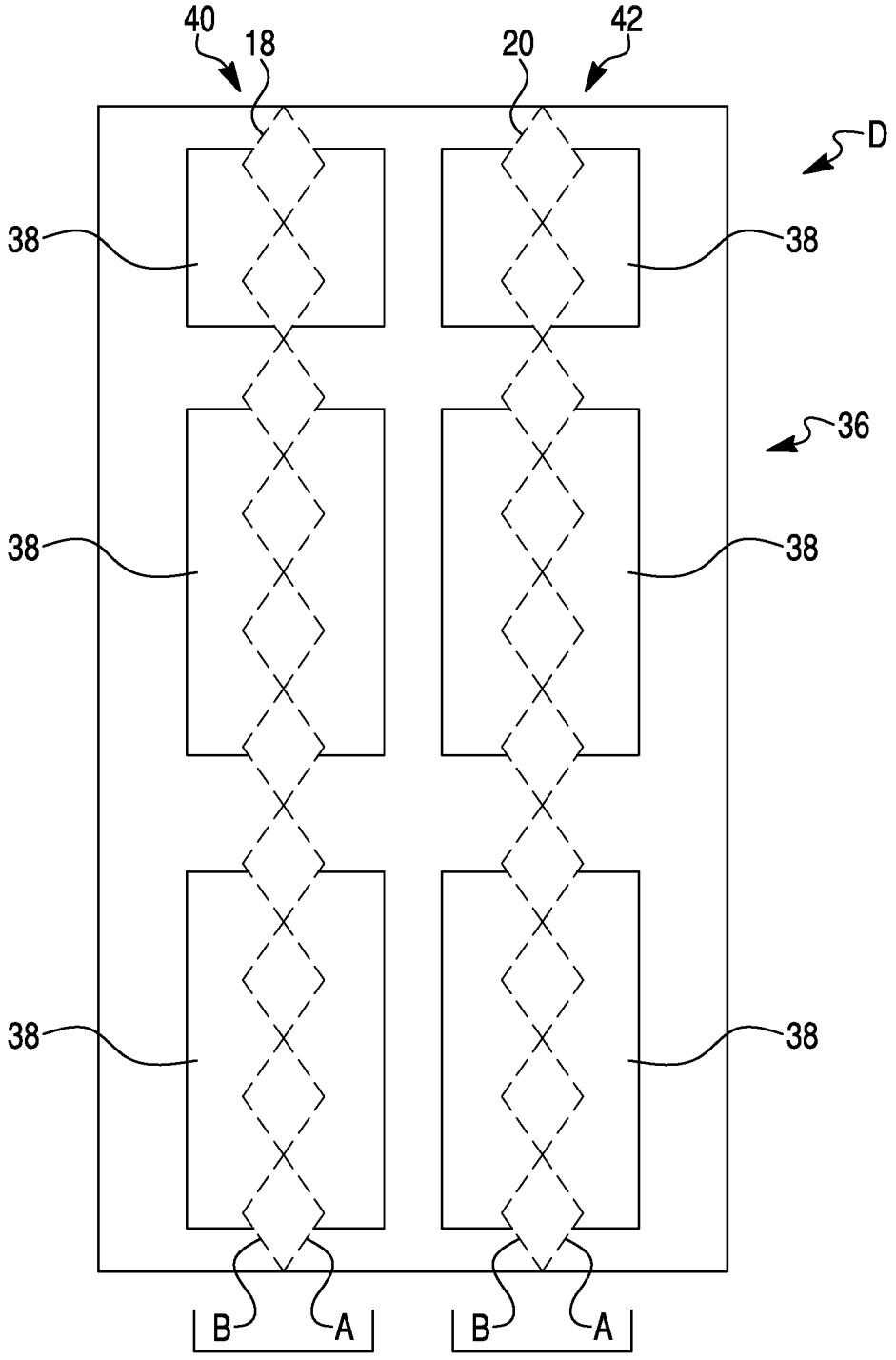
FIG. 4 is an elevational view of an exemplary six-molded-panel door according to an exemplary embodiment of the present disclosure.

FIGS. 2-4 illustrate various embodiments of a door according to exemplary embodiments of the present disclosure. FIG. 2 illustrates a two-molded-panel door according to an exemplary embodiment of the present disclosure. FIG. 3 illustrates a four-molded-panel door according to an exemplary embodiment of the present disclosure. FIG. 4 illustrates a six-molded-panel door according to an exemplary embodiment of the present disclosure. For clarity and ease of illustration, connective portions 22, 24, 26 are omitted from FIGS. 2-4 however at least one connective portion 22, 24, 26 would be present.

As best illustrated in FIG. 2, the door D comprises a pair of door skins (sometimes called door facings) disposed on either side of the frame 10. The door skins are typically the same configuration and may be made from wood composites, polymer composite, or steel. An exemplary door skin 28 having two molded panels 30 is illustrated in FIG. 2, and those skilled in the art will appreciate that a similarly configured door skin is attached to the opposite side of the frame 10. The molded panels 30 can be formed in the door skin 28 using various techniques. For example, the door skin 28 can be molded to include depressions or contours that create an appearance of molded panels 30 within the door D. While two molded panels are illustrated in FIG. 2, any number of molded panels can be formed within the door skin 28. The door skin 28 can further exteriorily include depressions or contours that simulate a wood grain pattern such as found in a natural piece of wood. When the door skins are attached to the frame 10, the skins and frame enclose the core component C including the backbones 18, 20 and any cellular portions.

The first backbone 18 and the second backbone 20 are arranged in parallel and are positioned toward the outer edge portions of the molded panels 30 (FIG. 2). For example, the backbone 18 is disposed within a predetermined distance of the left edge of the molded panels 30, and the backbone 20 is disposed within a predetermined distance of the right edge of the molded panels 30. For a two molded panel design (FIG. 2), each backbone preferably is no further from its respective outer edges of the molded panel than the center position of a four-molded-panel or six-molded-panel door of the same width. The proper positioning of the backbones 18, 20 ensures adequate coverage and support across the width of the door to mitigate oil canning.

At least one connective portion, such as connective portion 22, is between the backbones 18, 20. In addition, other connective portions, such as connective portions 24, 26, are disposed between the backbones 18, 20 and the frame 10. The core C, including the backbones 18, 20 and the connective portions 24, 26, is preferably used in an automated door assembly line, and thus is formed as an interconnected web that may be applied to the inner surface of the door skin 28.

The core C, with its backbones 18, 20 and connective portions 22, 24 and 26, is formed, preferably, from a plurality of strips A, B and E of cardboard or heavy weight paperboard, with the strips A, B and E being connected via a series of spaced adhesive lines that extend approximately half and optionally the entire thickness of a strip and which connect to an adjacent strip. In this way, the core C, formed from the interconnected strips, may be assembled initially in a collapsed form and affixed to the rails 12, e.g. by an adhesive, such as hotmelt. The web of interconnected strips A, B and E, once connected to rails 12 may be expanded and subsequently oriented between the skins 28 and extending between the rails 12 and the stile 14 when in the expanded form. Alternatively, as best shown in FIG. 8, the strips A, B and E may be interconnected via the cut lines and optionally also by adhesive. Regardless of whether adhesively secured or interconnected via cut lines, the core C is formed from a plurality of interconnected strips A, B and E that may be oriented in a first collapsed configuration and then into an expanded configuration, as best shown in FIG. 1. Expansion of the core C causes the backbones 18, 20 to be oriented relative to the molded panels 30 in order to provide support for the assembled door D.

The door D is formed by securing a first door skin 28 to frame 10. For example, door skin 28 can be secured to frame 10 using an adhesive applied to the opposed surfaces of the rails 12 and the stiles 14 of the frame 10. The adhesive can be applied by roll coating, spraying, or some other suitable means. The frame 10 is then aligned with the perimeter of the door skin 28, and secured thereto. Preferably exposed lengths of the cardboard strips A, B forming the core C are adhesively secured to rails 12 so that the rails 12 may be longitudinally displaced a distance corresponding to the height of door skin 28, and thus causing the core C to expand. Once the rails 12 have been spaced apart and the core C expanded, stiles 14 may be affixed to the rails 12 in to form the frame 10 suitable for being applied to the inner surface of door skin 28. Another door skin (not shown) is then aligned with the frame 10 and the core component C, and secured thereto. The placement of the second door skin 28 causes the lateral edges of the strips E forming core C to be contacted with the edges of the molded panels 30, thus providing support thereto in the assembled door D.

Figure 9:
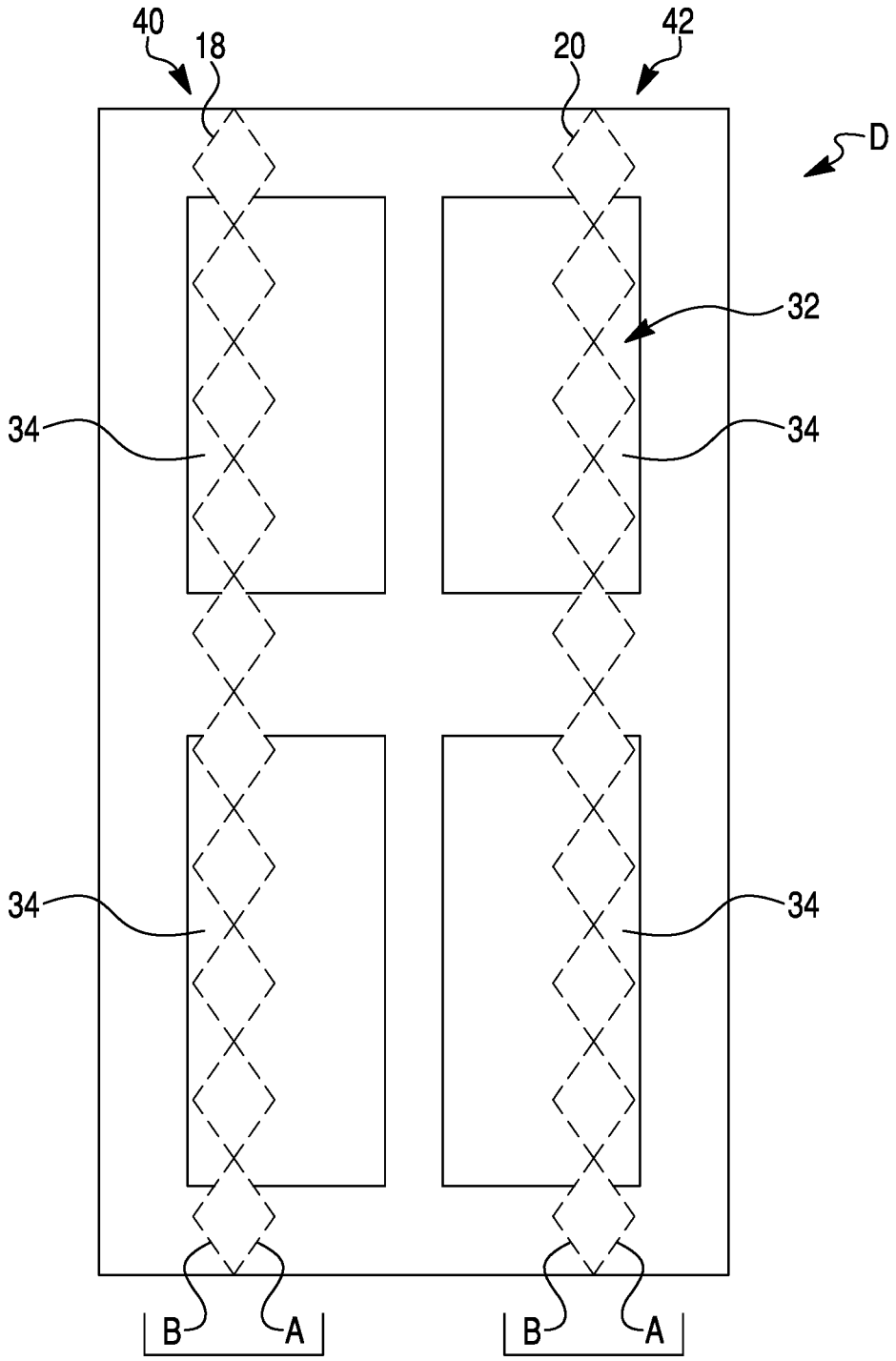
FIG. 9 is an elevational view of an exemplary four-molded-panel door according to another exemplary embodiment of the present disclosure.
Figure 10:
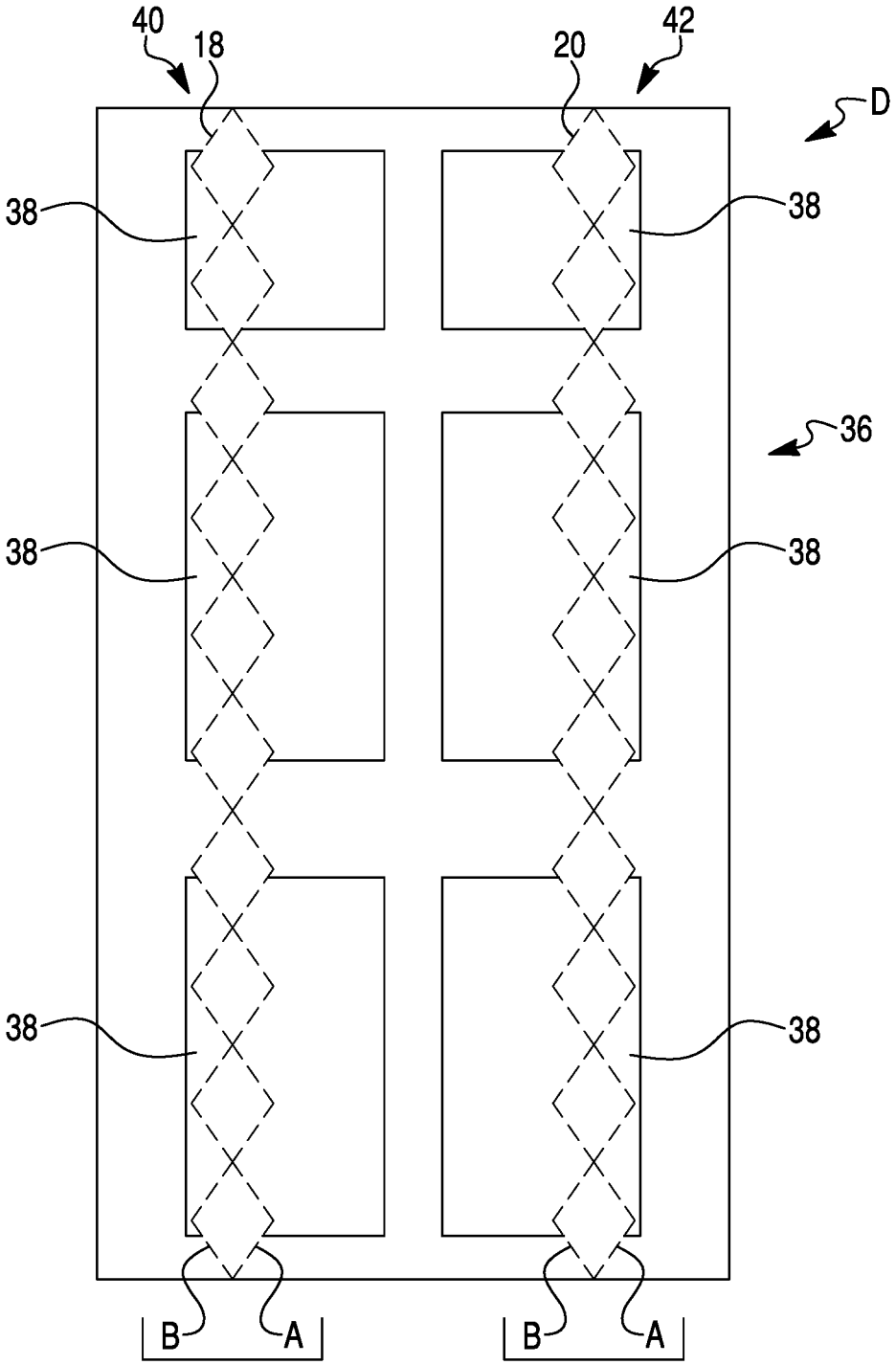
FIG. 10 is an elevational view of an exemplary six-molded-panel door according to another exemplary embodiment of the present disclosure.

FIG. 3 illustrates the door D comprising a door skin 32 having four molded panels 34, and FIG. 4 illustrates the door D comprising a door skin 36 having six molded panels 38. In FIGS. 3 and 4, the backbones 18, 20 are disposed such that one backbone is arranged at the center of each molded panel column. For example, the backbone 18 can be disposed at the center of the left column of molded panels, such as column 40, and the backbone 20 can be disposed at the center of the right column of molded panels, such as column 42. Preferably, however, for a four-molded-panel and six-molded-panel door, as best shown in FIGS. 9 and 10, each of the backbones 18, 20 is located between the middle of its respective molded panels and the outer edge of its respective molded panels to ensure adequate coverage and support across the width of the door facing to mitigate oil calming.

Doors having six molded panels, such as illustrated in FIG. 4, are relatively common and the core C positions the backbones 18, 20 under or adjacent the individual molded panels 38 in order to provide support and increased integrity at the molded panels 38. Prior cores, having a single, centrally located backbone, positioned the backbone along the center of the door skin and thus provided limited support to the adjacent molded panels. The core C of the invention, thus, is useful with one-molded-panel, two-molded-panel, three-molded-panel, four-molded-panel, or six-molded-panel doors. A single core C thus can be used with essentially all door designs.

The strips A, B and E have a thickness as defined by their parallel edges at least as thick as the frame 10 of the door D, and may be slightly thicker. When the door D is placed into a press during manufacture, the door skins are pressed against the frame 10. Likewise, when the door skins are being pressed during door D fabrication, the door skins press against and contact the opposite edges of the strips A, B and E. The core C thus engages the opposed door skins in order to provide the appropriate support. The support provided by the core C and the backbones 18, 20 increases resistance to oil canning, increases the structural integrity of the door D, and minimizes pillowing, especially in the multiple molded panel areas. The door facings may be adhesively coated in the area of the backbones in order to attach firmly to the core C and its backbones 18, 20. Alternatively, the opposite edges of the strips A, B and E may be adhesively coated to bond to the door facings when the facings are assembled into a door D.

Further, the parallel backbones 18 and 20 minimize any tendency of the core C to twist as the core C is being expanded by separation of the rails 12 during formation of the frame 10. A single backbone, as with prior cores, might twist during automated assembly of doors, with the result that the core would not be properly oriented for use in the associate door. Additional labor would thus be required to orient the core, resulting in increased assembly time.

It will be apparent to one of ordinary skill in the art that various modifications and variations can be made in construction or configuration of the present invention without departing from the scope or spirit of the invention. Thus, it is intended that the present invention cover all such modifications and variations, and as may be applied to the central features set forth above, provided they come within the scope of the following claims and their equivalents.

What is claimed is:

1. A door, comprising:

a. a peripheral frame;

b. first and second door skins secured to opposite sides of the frame, each of said door skins having an exterior surface and an interior surface and each of the door skins having a plurality of molded panels; and c. a double backbone core component disposed between the interior surfaces of said door skins, wherein the double backbone core comprises two backbones with expandable cells extending parallel to each other along a length dimension of the frame, wherein each of the backbones extends the length of the frame, and extends between and directly engages opposed interior surfaces of the panels to support a different molded panel of the first and second door skins wherein each of said door skins has a plurality of molded panels arrayed in two longitudinally extending columns, and each of said backbones is positioned between a middle of one of said columns of panels and an outer edge of the same column of panels.

2. The door of claim 1, wherein the core component is formed from a plurality of interconnected strips, each strip is made of cardboard or paperboard.

3. The door of claim 1, wherein the core component further comprises connective portions connecting the backbones, and has cells of a first size forming the connective portions and cells of a second, smaller size forming the backbones.

4. The door of claim 1, wherein the core component is adhesively secured to spaced rails forming said frame.

5. The door of claim 2, wherein said strips are of a uniform thickness, the uniform thickness of the strips being defined by spaced parallel edges of associated strips.

6. A door, comprising:

a frame including a pair of stile members extending parallel to each other, an upper rail member and a lower rail member, wherein the upper rail member and the lower rail member are disposed in parallel to each other and are coupled between the pair of stile members;

at least two door skins attached to said frame, each of the door skins having first molded panels laterally spaced from second molded panels; and a structural void filler disposed within said frame, wherein said structural void filler comprises a first backbone, a second backbone, and a connective cellular core interconnecting the first and second backbones, wherein the first and second backbones have higher fill density than the connective cellular core, the first and second backbones extending the length of the frame and extending between and directly engaged with inner surfaces of the opposed door skins, and the first backbone is positioned to support opposed first molded panels of the door skins, and the second backbone is positioned to support opposed second molded panels of the door skins, wherein the first backbone is located between a middle of the first molded panels and an outer edge of the first molded panels, and the second backbone is located between a middle of the second molded panels and an outer edge of the second molded panels wherein the first molded panels are laterally spaced from the second molded panels on each door skin.

7. The door of claim 6, wherein a portion of the connective cellular core is disposed between the first backbone and the second backbone.

8. The door of claim 6, wherein the first backbone and the second backbone each comprise a plurality of cells having a first area and the connective cellular core comprises a plurality of cells having a second area greater than the first area.

9. The door of claim 6, wherein the structural void filler further comprises a portion of the connective cellular core disposed between the first backbone core and one of the stile members and a portion of the connective cellular core disposed between the second backbone core and the other of the stile members.

10. The door of claim 6, wherein the structural void filler is formed from a plurality of interconnected strips, each of the strips formed from a member selected from the group consisting of cardboard and paperboard.

11. The door of claim 10, wherein each of, said strips is formed from the same material as the other strips.

12. The door of claim 11, wherein each of said strips has a common thickness, the common thickness of each strip being defined by the distance between spaced parallel edges of each strip.

13. The door of claim 12, wherein the thickness is at least equal to the thickness of said frame.

14. The door of claim 13, wherein each of the first and second molded panels are arrayed in two longitudinally extending columns, respectively.

15. The door of claim 14, Wherein each of said strips has a plurality of slits extending therethrough, said strips being interconnected at the slits.

* * * * *